US010322416B2

(12) United States Patent
Fader et al.

(10) Patent No.: US 10,322,416 B2
(45) Date of Patent: Jun. 18, 2019

(54) METHOD AND SYSTEM FOR UPPER PILL-CRUSHING-CUP DETECTION

(71) Applicant: Cougar Mountain Marketing Corporation, Surrey (CA)

(72) Inventors: Aaron Edward Fader, White Rock (CA); Yin Kwong William Tang, Hong Kong (HK)

( * ) Notice: Subject to any disclaimer, the term of this patent is extended or adjusted under 35 U.S.C. 154(b) by 315 days.

(21) Appl. No.: 15/284,925

(22) Filed: Oct. 4, 2016

(65) Prior Publication Data

US 2018/0093276 A1 Apr. 5, 2018

(51) Int. Cl.
*B02C 25/00* (2006.01)
*A61J 7/00* (2006.01)

(52) U.S. Cl.
CPC ..... *B02C 25/00* (2013.01); *A61J 7/0007* (2013.01)

(58) Field of Classification Search
CPC ..... B02C 25/00; A61J 7/0007
USPC ..... 241/DIG. 27
See application file for complete search history.

(56) References Cited

U.S. PATENT DOCUMENTS 5,618,004 A * 4/1997 Klearman ..... A61J 7/0007 241/169.2
6,059,209 A * 5/2000 Barson ..... A61J 7/0007 241/168
6,357,679 B1 * 3/2002 Radke ..... A61J 7/0007 241/169.1
7,427,041 B2 * 9/2008 Hall ..... B02C 19/08 241/168
7,543,770 B2 * 6/2009 Peron ..... A61J 7/0007 241/169
7,735,763 B2 * 6/2010 Bell ..... B02C 19/08 241/169.1
7,896,273 B2 * 3/2011 Grah ..... A61J 7/0007 241/169.1
8,740,119 B2 * 6/2014 Anderson ..... B02C 19/08 241/169
2003/0168538 A1 9/2003 Dobson
2006/0088422 A1 4/2006 Hall

OTHER PUBLICATIONS

Patent Cooperation Treaty International Search Report and Written Opinion of the International Searching Authority dated Jun. 27, 2017, issued for the equivalent application assigned International Application No. CA2016/051336 with an International Filing Date of Nov. 16, 2016.

* cited by examiner

*Primary Examiner* — Faye Francis

(57) ABSTRACT

A sensor detects the presence of an upper cup in a pair of cups, between which pills are crushed by machine. Operation of the crushing machine is prevented if the upper cup is absent, and enabled if the upper cup is present. The sensor may be a photodiode that is sensitive to a beam of laser light that is directed over the lower cup. The beam passes when the upper cup is absent and is blocked by the upper cup when present. An optional sensor may be included to detect whether the drawer containing the cups and pills is closed, which is used as a further condition that must be satisfied before crushing can be started. Also, an interlock can be included to prevent the drawer from opening during the crushing process. By ensuring the presence of the upper cup, the escape of powdered medication can be prevented.

20 Claims, 4 Drawing Sheets

METHOD AND SYSTEM FOR UPPER PILL-CRUSHING-CUP DETECTION

TECHNICAL FIELD

This application relates to pill crushing. More particularly, this application relates to a method and system for detecting an upper cup that is placed in a lower cup containing a pill to be crushed by machine, and preventing operation of the machine unless the upper cup is detected.

BACKGROUND

Often patients have difficulty swallowing medications in tablet or pill form; however for many medications, this is the only form in which it is available. Also, many pills come with coatings or are otherwise designed to break down after ingestion, but in cases where patients are very young, elderly, and/or ill this breakdown of medication is disrupted and either occurs much slower than desired or not at all. In order to more easily and effectively administer medications in such cases, pills are often comminuted with a mortar and pestle or other mechanical device that generally crushes and/or grinds the pill between two hard surfaces. Once the pills are comminuted the powder is generally transferred to a container where it is mixed with fluid or food for administering to a patient.

In order to reduce cross-contamination and material loss, pairs of inexpensive, single use, nesting containers are used to comminute one or more pills between the bottoms of the nesting containers. These containers can then be separated and the comminuted medication can then be scraped and mixed or suspended in a fluid or food for administering to a patient.

When a machine is used to comminute the medication, it is often easy for the operator of the machine to forget to place the upper cup in place over the lower cup containing the medication. As a result, when the medication is crushed it creates a mess that is difficult to clean up, and to clean up safely. Furthermore, the machine can create toxic airborne dust, there can be a loss of dosage of the medication, and there can be cross-contamination between the medications given to different patients if the crushing chamber of the machine is not thoroughly cleaned. On top of this, it causes down-time and delays in a care-giver's schedule. The outcome of not placing a second cup on top of the pills in the first cup is therefore costly and hazardous.

This background information is provided to reveal information believed by the applicant to be of possible relevance to the present invention. No admission is necessarily intended, nor should be construed, that any of the preceding information constitutes prior art against the present invention.

SUMMARY OF INVENTION

The present invention is directed to a method and system for use in a pill-crushing machine, which incorporates a sensor for detecting the presence of an upper cup over a lower cup containing one or more pills. The sensor sends a signal that prevents operation of a crushing mechanism unless the upper cup is detected.

A further, optional sensor may detect when a drawer carrying the cups is fully inserted into the machine, this further sensor producing a signal that only allows operation of the crushing mechanism when the drawer is fully inserted.

For operation of the mechanism, both the upper cup must be present and the drawer must be closed.

Disclosed herein is a system for controlling operation of a pill-crushing mechanism, the system comprising a cup holder configured to hold a lower cup with one or more pills therein and an upper cup nestled in the lower cup over said pills; a sensor located in relation to the cup holder so that the sensor has a first state that corresponds to an absence of the upper cup from the cup holder and a second state that corresponds to a presence of the upper cup in the cup holder, nestled in the lower cup over said pills; and a controller that receives signals from the sensor corresponding to said states, wherein the controller prevents operation of a mechanism for crushing said pills when the sensor is in the first state and enables operation of the mechanism when the sensor is in the second state.

Some embodiments of the system may comprise a source of electromagnetic radiation positioned so that: the source directs said radiation onto the sensor when the upper cup is absent from the cup holder; and the radiation is blocked from being incident upon the sensor when the upper cup is present over the pills in the lower cup in the cup holder; wherein the sensor is sensitive to said radiation.

In some embodiments, the source and sensor are positioned so that: the radiation passes above the lower cup when the lower cup is present in the cup holder and the upper cup is absent from the cup holder; and the radiation is blocked from being incident upon the sensor by a wall of the upper cup when the upper cup is present over the pills in the lower cup in the cup holder.

Some embodiments of the system may include a drawer in which is mounted the cup holder, wherein the drawer slides into and out of a pill-crushing machine that comprises the mechanism. Some embodiments of the system may further comprise a laser diode positioned so that: the laser diode directs radiation onto the sensor along a path that is above the lower cup when the lower cup is present in the cup holder and the upper cup is absent from the cup holder; and the radiation is blocked from being incident upon the sensor by a wall of the upper cup when the upper cup is present over the pills in the lower cup in the cup holder; wherein the sensor is sensitive to the radiation; and wherein the path is nearer to an inner edge of the cup holder than an outer edge of the cup holder such that the drawer must be substantially closed for the wall of the upper cup to block the path.

Further disclosed herein is a system for controlling operation of a pill-crushing mechanism, the system comprising: a drawer that slides into and out of a pill-crushing machine that comprises the pill-crushing mechanism; a cup holder mounted in the drawer and configured to hold: a lower cup with one or more pills therein; and an upper cup nestled in the lower cup over said pills; a sensor located in relation to the cup holder so that the sensor has: a first state that corresponds to an absence of the upper cup from the cup holder; and a second state that corresponds to a presence of the upper cup nestled in the lower cup over said pills; a magnet mounted in the drawer; and a magnetic sensor mounted in the machine so that it: detects the magnet when the drawer is closed; and does not detect the magnet when the drawer is not closed; and a controller that receives signals from the sensor that are representative of the sensor's state, and further signals from the magnetic sensor that are representative of whether the drawer is closed, wherein the controller: prevents operation of the mechanism when the sensor is in the first state or when the drawer is not closed; and enables operation of the mechanism when both the sensor is in the second state and the drawer is closed.

Still further disclosed is a method for controlling operation of a pill-crushing mechanism, comprising the steps of: locating a sensor in relation to a cup holder so that the sensor has: a first state that corresponds to an absence of an upper cup from a lower cup being held by the cup holder; and a second state that corresponds to a presence of the upper cup nestled in the lower cup over one or more pills in the lower cup; detecting, by the sensor, whether the upper cup is nestled in the lower cup over the one or more pills therein; receiving, by a controller, a first signal from the sensor when the sensor is in the first state; preventing, by the controller, operation of a mechanism for crushing said pills in response to the first signal; receiving, by the controller, a second signal from the sensor when the sensor is in the second state; and enabling, by the controller, operation of the mechanism when the sensor in response to the second signal.

In some embodiments, the method further comprises: emitting electromagnetic radiation from a source; directing said radiation onto the sensor when the upper cup is absent from the lower cup being held by the cup holder; and blocking said radiation from being incident upon the sensor by the upper cup when the upper cup is present over the pills in the lower cup; wherein the sensor is sensitive to said radiation.

In some embodiments, the method further comprises: detecting whether a drawer holding the lower cup, the pills and the upper cup is closed in a machine comprising the pill-crushing mechanism; preventing operation of the mechanism when the drawer is not closed; and detecting, before the enabling step is undertaken, that the drawer is closed.

BRIEF DESCRIPTION OF DRAWINGS

The following drawings illustrate embodiments of the invention, which should not be construed as restricting the scope of the invention in any way.

DESCRIPTION

A. Glossary

The term "comminution" refers to the crushing of pills into powder form.

The term "system" when used herein refers to a system for detecting an upper cup that is placed in a lower cup containing a pill to be crushed by machine, and preventing operation of the machine unless the upper cup is detected.

The term "operator" or "user" refers to a person who uses a pill-crushing machine to crush pills.

B. Industrial Applicability

The method and system of the present invention are useful for safely crushing pills between two cups in a pill-crushing machine. It prevents mess and wastage of medication, reduces the chance of cross-contamination, reduces potentially toxic airborne medication dust, and saves time.

C. Overview

Figure 1:
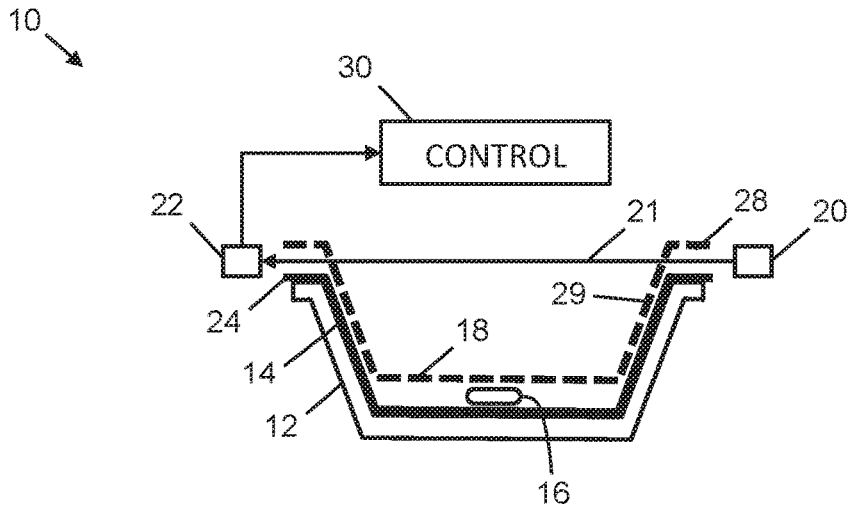
FIG. 1 is a schematic diagram showing a front view of the main elements of the system, according to an embodiment of the present invention.

Referring to FIG. 1, there is shown an overview of the main components of the system 10 for preventing operation of a pill-crushing mechanism unless it is safe to do so. The system 10 forms part of a pill-crushing machine, and includes a cup holder 12, into which is placed a lower cup 14. One or more pills 16 are placed into the lower cup 14 and an upper cup 18 is then nestled inside the lower cup and placed over the pills. A laser 20 is positioned relative to the cup holder 12 such that the laser beam 21 produced by the laser is directed over the lip 24 of the lower cup 14, when the lower cup is properly placed in the cup holder, as shown, and when there is no upper cup 18 present. A sensor 22 is positioned relative to the cup holder 12 such that it can detect the laser beam 21 emitted by the laser 20 when the lower cup 14 is properly in position in the cup holder, and when there is no upper cup present. The positions of the laser 20 and sensor 22 relative to the cup holder 12 are also such that, when the upper cup 18 is present, its wall 29 blocks the path of the laser beam 21 between the laser 20 and sensor 22. To achieve this, the laser 20 is located such that the laser beam 21 is below the level of the lip 28 of the upper cup 18 if the upper cup were present over pills 16.

As a consequence of the relative positioning and orientation of the laser 20, sensor 22 and cup holder 12, the sensor has at least two states corresponding to the two different levels of laser light detected, which result from the upper cup 18 being present or not. The sensor 22 sends the signals to the control module 30, which controls operation of the pill-crushing mechanism. If the sensor 22 detects the laser beam 21, then the signal sent to the control module 30 effectively instructs it to prevent operation of the pill-crushing mechanism. If the sensor 22 detects absence of the laser beam 21, or a significant reduction in intensity of laser light, then the signal sent to the control module 30 effectively instructs it to enable operation of the pill-crushing mechanism. Once the operation of the pill-crushing mechanism is enabled, a user of the pill-crushing machine is then able to start the pill crushing by pressing a start button.

As can be seen from FIG. 1, the height of the laser beam 21 needs to be only just above the upper surface of the lip 24 of the lower cup 14. This can be calculated by taking into account the thickness of the lip 24 of the lower cup 14. The beam 21 should not be so low as to be blocked by an extra cup that is placed over the first cup 14 without any pills present in the first cup, just in case two lower cups are used by accident. As an example, the laser 20 may be positioned so that the center of the laser beam 21 is at a height of 2 mm above the upper surface of the cup holder 12. This will not be blocked by a single lower cup 14 having a lip 24 that is 0.7 mm thick, or even two lower cups, but it will be blocked by a combination of a lower cup (lip 0.7 mm), small pill (1.5 mm thick) and upper cup (lip 0.7 mm), which would have a total height of about 3 mm. Obviously the laser beam will be blocked if larger pills are crushed. The positioning of the laser 20 and sensor 21 relative to the cup holder 12 will therefore depend on the dimensions of the cups that are to be used, and the pills that are to be crushed, and the relative positioning may be different in other embodiments.

As an example, the laser 20 may be a 650 nm red diode laser and the sensor may be a photodiode with sensitivity in the visible and near infrared spectrum. Since the laser beam 21 diverges, spurious reflections may be present inside the crushing chamber, and so the sensor 22 may always detect some amount of laser light even if the main beam 21 is directly blocked. Depending on the type of material of the cups 14, 18, which is typically plastic, and thickness of the cup walls, some of the laser light may be transmitted through the cups, but the amount transmitted will be measurably less than the unblocked laser beam. The detection of the spurious or transmitted laser light can be used as a test to ascertain that the laser 21 is functioning properly, or that it has not been deliberately blocked to circumvent the safety feature that it brings to the pill-crushing machine.

The control module 30 is built using known components and techniques. Other control modules for pill-crushing mechanisms already exist. The added features in control module 30 compared to known control modules are (a) the prevention of operation of the pill-crushing mechanism when the sensor detects a high intensity of laser light, i.e. an intensity above a predetermined threshold and (b) the enablement of operation of the pill-crushing mechanism when the sensor detects a low intensity of laser light, i.e. an intensity below the same or a lower predetermined threshold, which would of course include detecting no laser light.

D. Exemplary Embodiment

Figure 2:
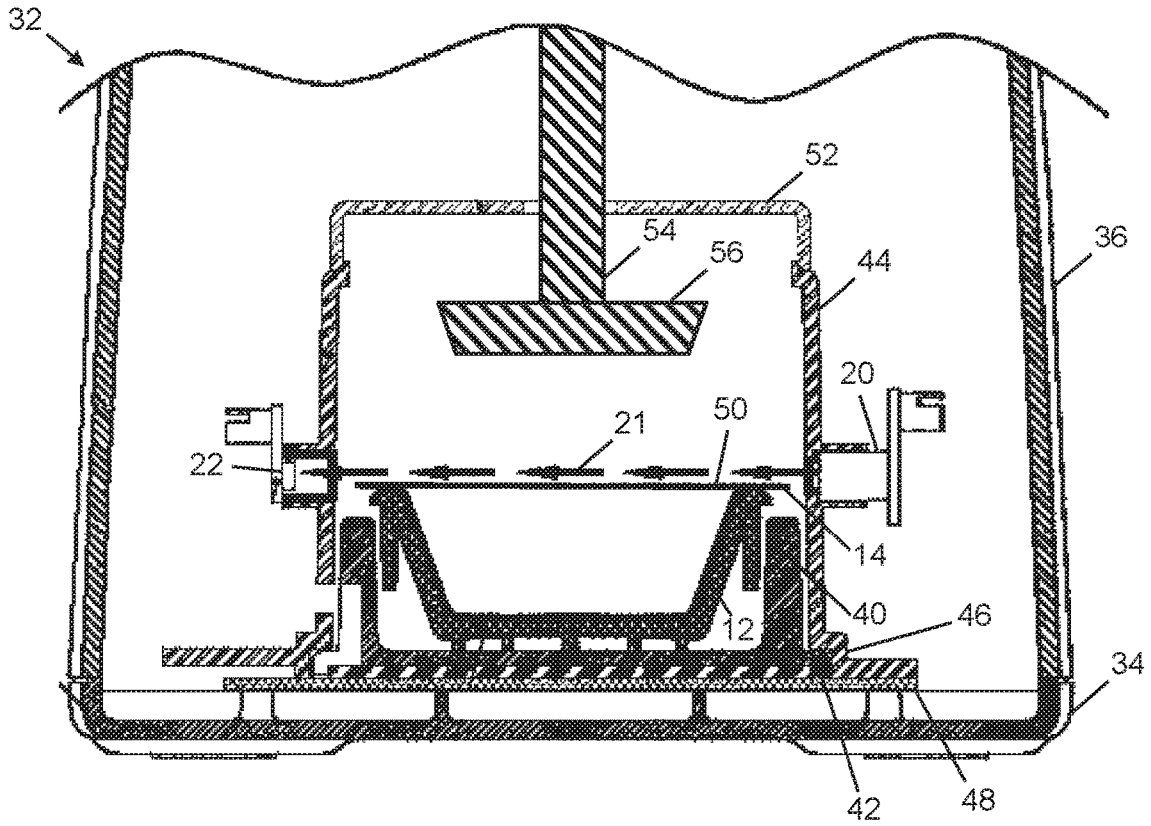
FIG. 2 is a partial cross-section drawing of a pill-crushing machine including the system according to an embodiment of the present invention, with only a lower cup inserted.

Referring to FIG. 2, a pill-crushing machine 32 is shown embodying the system 10 of the present invention. The components of the machine 32 that are shown include a bottom housing 34 and a front housing 36. Also shown is a drawer 40 in which is mounted the cup holder 12. The drawer 40 slides into and out of the machine 32 on runners 42 at the bottom of the drawer. The direction the drawer 40 slides is perpendicularly into and out of the plane of the drawing. The drawer 40 slides into a crushing chamber 44 within the machine 32. At the bottom of the crushing chamber 44 are steps 46, the insides of which serve to guide the runners 42 of the drawer 40, which slide on the upper surface of baseplate 48.

The laser 20 produces laser beam 21, which is detected by sensor 22 when only the lower cup 14 is present. The laser beam 21 is shown to pass above the upper surface 50 of the lip of the lower cup 14.

The top of the crushing chamber 44 is fitted with a cover 52, through which the drive shaft 54 of the pill-crushing mechanism passes. The drive shaft 54 forms part of the pill-crushing mechanism and is controlled by the control unit 30. At the base of the drive shaft 54 is a pressure plate 56 for imparting pressure to and rotating the base of the upper cup when present, while the cup holder 12 retains the lower cup 14 stationary. When there is only the lower cup 14 present, the overall height of the contents of the cup holder 12 is not enough to block the laser beam 21 and the signal sent from the sensor 22 to the control module 30 is such that the crushing process cannot be performed.

The laser 20 is a 650 nm red diode laser model RLD650005 from Dongguan Yuquan Electronics Co. Ltd. and the sensor 22 is a BPW34 photodiode from Vishay Semiconductors. Other laser diodes and photodiodes may be used in other embodiments, and the wavelength may be a different wavelength, which may be in the visible or non-visible spectrum.

Figure 3:
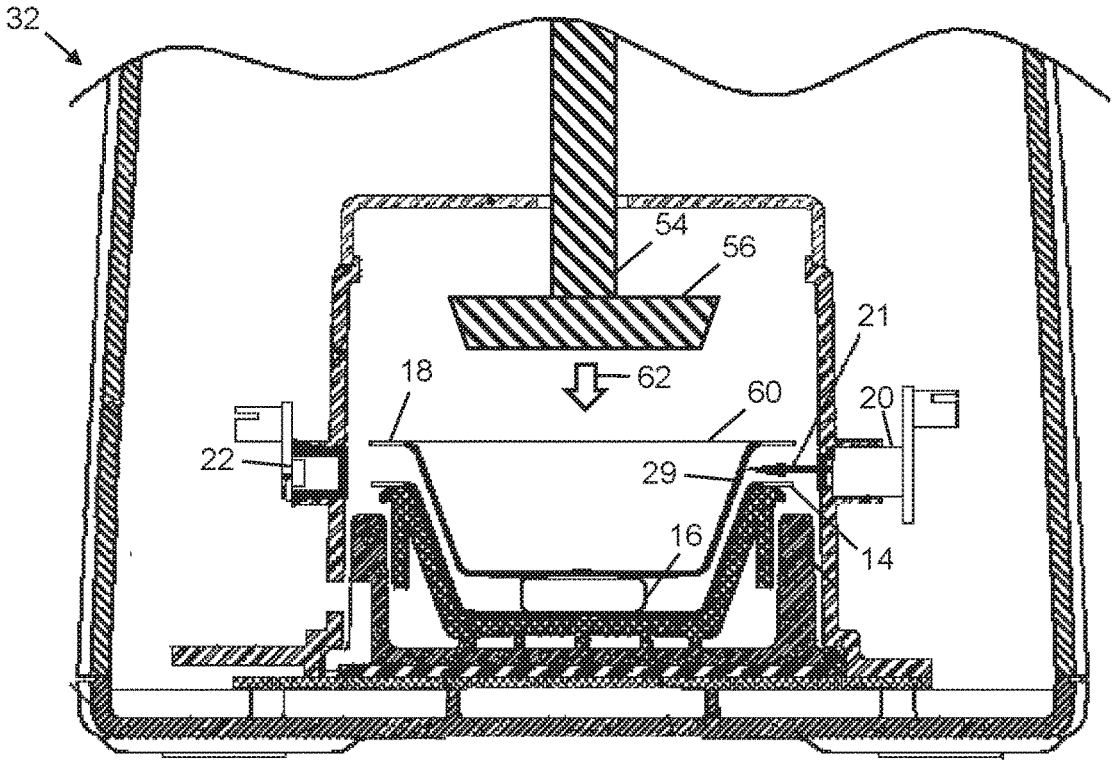
FIG. 3 is a partial cross-section drawing of a pill-crushing machine including the system according to an embodiment of the present invention, with both lower and upper cups inserted.

Referring to FIG. 3, the pill-crushing machine 32 is shown with both a lower cup 14 and an upper cup 18, with a pill 16 between the two. The upper surface 60 of the upper cup 18 is shown to be above the height of the laser beam 21. The laser beam 21 is therefore blocked by the wall 29 of the upper cup 18 so that it does not directly illuminate the sensor 22. As a result, the signal sent from the sensor 22 to the control module 30 is such that operation of the pill-crushing mechanism is enabled. When in the enabled state, the pill-crushing mechanism can be started by the user activating a button or switch, causing the drive shaft 54 and pressure plate 56 to lower in the direction of the arrow 62 into the upper cup 18 and rotate it relative to the lower cup 14. The relative rotation of the two cups 14, 18 and the pressure between them causes the pill 16 to be crushed into powder. Physical relief features (not shown) on the bases of the cups 14, 18 assist in the crushing process.

Figure 4:
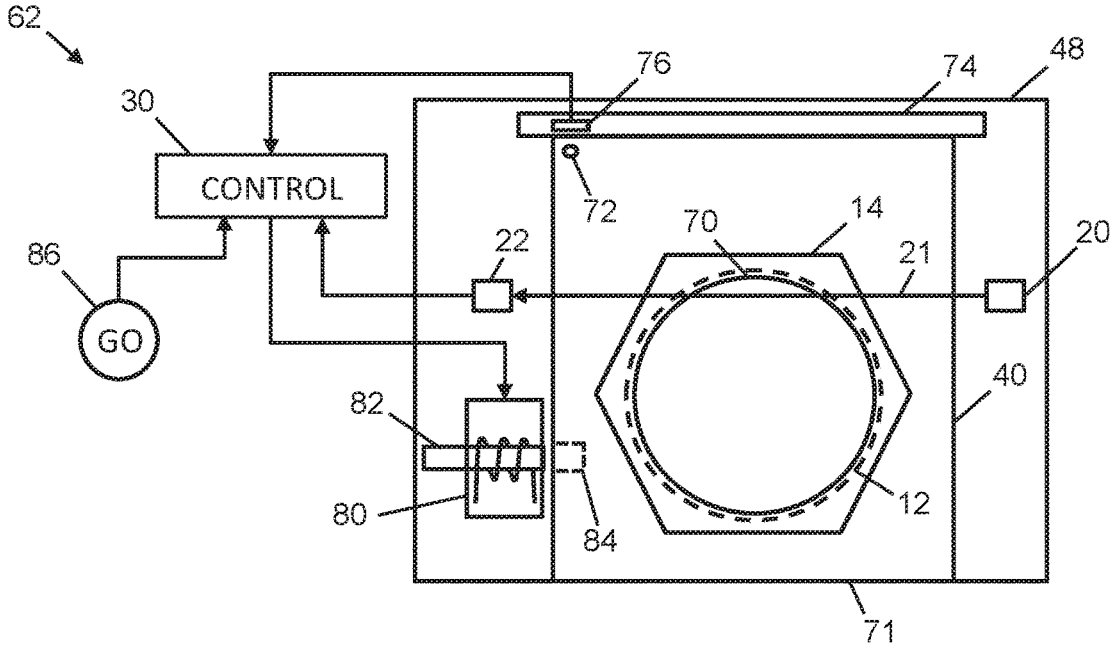
FIG. 4 is a schematic diagram of the system showing a top view of the main elements of the system including an optional closed-drawer detector, according to an embodiment of the present invention.

FIG. 4 shows a top view of a system 62 for safely operating a pill-crushing mechanism. The laser 20 and sensor 22 are located so that the laser beam 21 sections the wall 70 of the lower cup 14 when viewed from above. Provided that enough of the wall is sectioned, it follows that the upper cup 18, when placed in the lower cup 14, will block the laser beam 21. Since the laser beam 21 is arranged to section the innermost portion of the cup wall 70, i.e. the portion of the wall farthest from the front, outer edge 71 of the drawer 40, the drawer must be fully, or at least sufficiently, inserted as well as having an upper cup 18 present in order for the laser beam 21 to be blocked. As a result, the pill-crushing mechanism is only enabled if two conditions are satisfied, these being (a) two cups 14, 18 are used with one or more pills 16 therebetween; and (b) the drawer 40 is fully inserted into the pill-crushing machine 32.

In other embodiments, the laser 20 and sensor 22 may be aligned to be diametrically opposite the cup holder 12 from each other, or they may be located closer to the front 71 of the drawer 40.

E. Variations

Still referring to FIG. 4, system 62 includes two further safety features that contribute to the safe operation of the pill-crushing mechanism. The first is the secondary detection that the drawer 40 is fully inserted into the pill-crushing machine. This is achieved by the inclusion of a magnet 72 that is mounted in the drawer 40. When the drawer 40 is fully inserted, it butts up against a backstop 74 (for example), on which is mounted a reed switch 76. When the drawer 40 is butted up against the backstop 74, the magnet 72 is close enough to the reed switch 76 to activate it. Activation of the reed switch 76 is detected by the control module 30. When the reed switch 76 is not activated, the control module 30 prevents operation of the pill-crushing mechanism. When the reed switch 76 is activated, the operation of the pill-crushing mechanism is enabled so that it can be started by a user of the pill-crushing machine. The control unit 30 is configured to enable operation of the pill-crushing mechanism when both the reed switch 76 is activated and when the sensor 22 detects the presence of an upper cup 18, simultaneously. The control unit 30 is also configured to prevent operation of the pill-crushing mechanism when either the reed switch 76 is not activated or when the upper cup 18 is not detected. A magnetic sensor other than a reed switch may be used in other embodiments.

The second further safety feature is an interlock, i.e. the locking of the drawer 40 in its fully inserted position while the pill-crushing mechanism is operating. To achieve this, a solenoid 80 is mounted in the pill-crushing machine by the side of the drawer 40. The core 82 of the solenoid 80 acts as a bolt that is inserted into a bolt hole 84 on the side of the drawer 40 when the solenoid is activated. The bolt 82 prevents the drawer 40 from opening when it is inserted into the bolt hole 84. The solenoid 80 is activated when the operator of the pill-crushing machine starts the pill-crushing process by pushing button 86, and is deactivated when the pill-crushing mechanism stops. When the solenoid 80 is deactivated, the bolt 82 is retracted back out of the bolt hole 84, allowing the drawer 40 to be opened.

The button 86 may signal to the operator whether the crushing mechanism is enabled or not. For example, a red light may be illuminated around the button 86 to indicate that the pill-crushing machine is not ready, either because there is no upper cup present or because the drawer is not fully inserted into the machine. When the machine is ready, i.e. the upper cup is present and the drawer is fully closed, a blue light is illuminated around the button 86 instead of the red light. Other signaling techniques are also possible.

Figure 5:
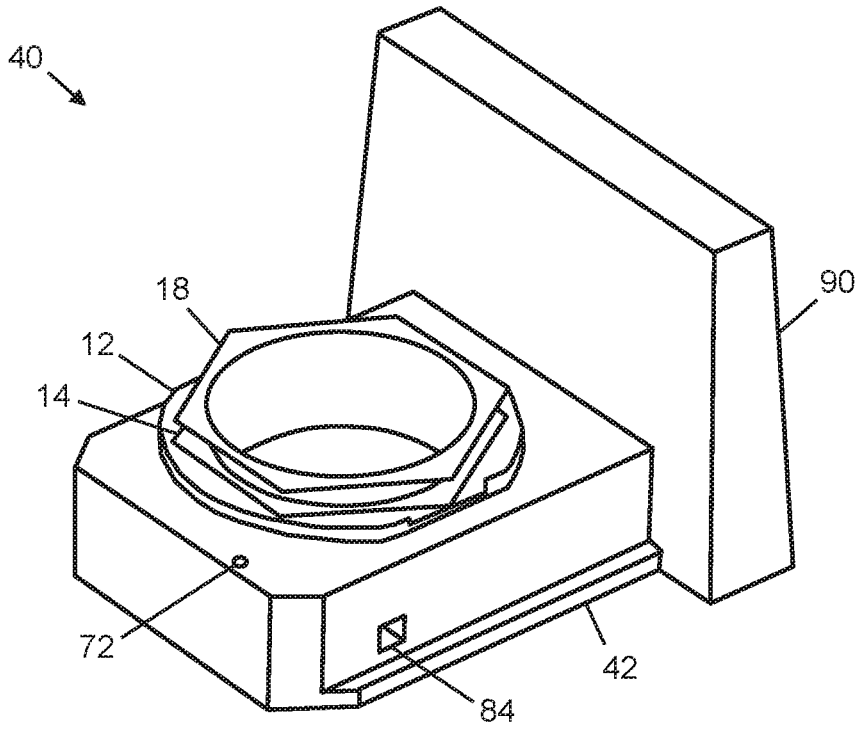
FIG. 5 is a perspective view of a drawer including magnet and bolt hole, according to an embodiment of the present invention.

Referring to FIG. 5, a drawer 40 is shown with a front wall 90 that closes the crushing chamber 44 when the drawer is fully inserted into the pill-crushing machine 32. Visible in this view is the cup holder 12, lower cup 14, upper cup 18, runner 42, optional magnet 72 and optional bolt hole 84.

F. Method

Figure 6:
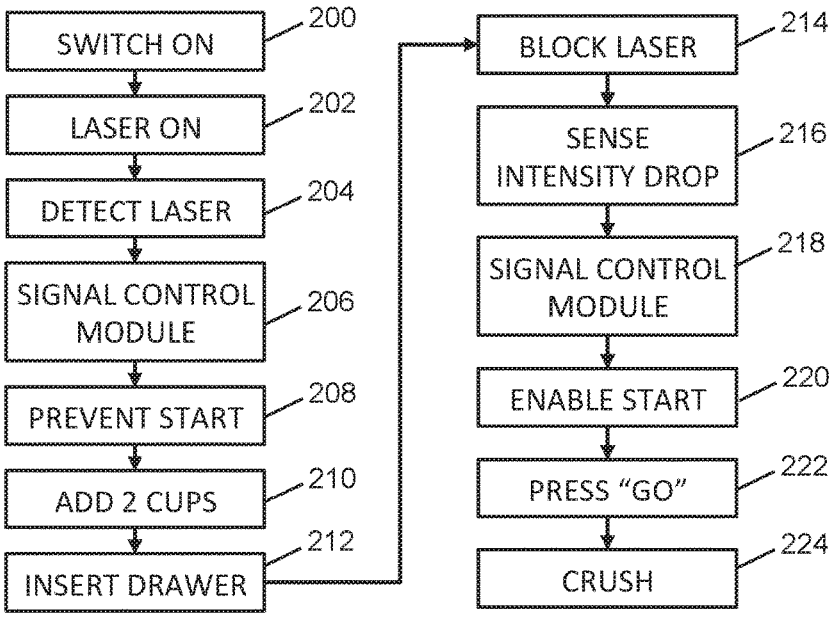
FIG. 6 is a flowchart of a method for preventing operation of a pill-crushing mechanism unless an upper cup is placed over medication present in a lower cup, according to an embodiment of the present invention.

Referring to FIG. 6, a method is shown for preventing operation of a pill-crushing mechanism until an upper cup is in position. In step 200, the pill-crushing machine is switched on, which results in the laser 20 being switched on, in step 202. As a result of the laser 20 being switched on, the sensor detects the laser in step 204, and in step 206 sends a signal to the control module 30. In step 208, the control module 30 prevents the starting of the pill-crushing mechanism, even if a start button 86 is pressed and even if there is a lower cup 14 in the drawer 40.

In step 210, an operator of the pill-crushing machine places one or more pills 16 into a lower cup 14 and places an upper cup 18 over the pills, and then places both cups with the pills therebetween into the drawer 40. The operator then, in step 212, fully inserts the drawer 40 loaded with the lower cup 14, pills 16 and upper cup 18 into the pill-crushing machine 32. In step 214, the upper cup 18 in the inserted drawer 40 blocks the laser beam 21, which is sensed by sensor 22 in step 216 as an intensity drop of the light detected. In step 218, the sensor 22 sends a corresponding signal to the control module 30, which, in step 220 enables the starting of the pill-crushing mechanism. In step 222, an operator of the pill-crushing machine presses a start button, which causes the control module 30, in step 224, to activate the drive shaft 54 and pressure plate 56 of the pill-crushing mechanism to crush the pills 16.

Figure 7:
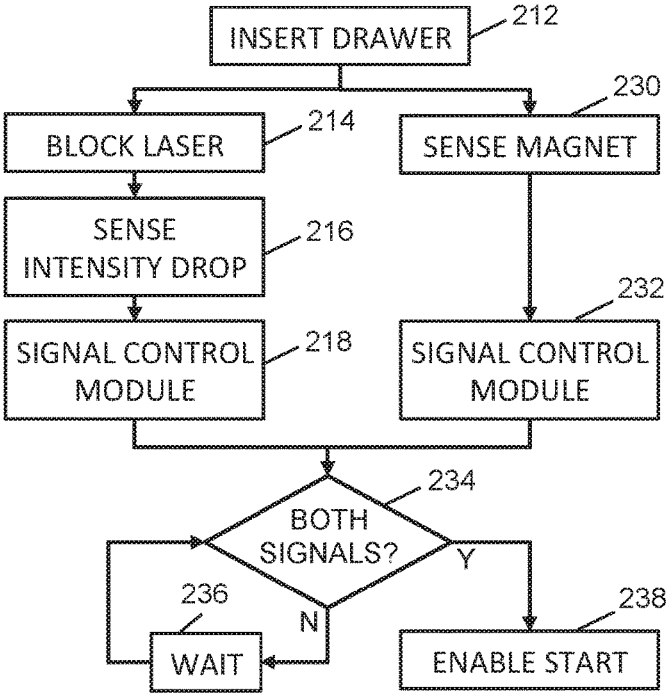
FIG. 7 is a flowchart of additional method steps for preventing operation of a pill-crushing mechanism unless a cup-holding drawer is placed fully into the crushing machine, according to an embodiment of the present invention.

FIG. 7 shows optional steps related to the magnet 72 and reed switch 76. In step 212, the drawer 40, loaded with two cups 14,18 and one or more pills 16 therebetween, is fully inserted into the pill-crushing machine 32, as above. Also as above, in step 214 the laser is blocked by the upper cup 18, in step 216 the sensor 22 detects a drop in laser intensity incident upon it, and in step 218 the sensor sends a signal to the control module 30. In parallel with steps 214-218, the reed switch 76 senses the magnet 72, in step 230, as a result of the drawer 40 being fully closed. In step 232, as a result of the reed switch operating, a signal is sent to the control module 30. In step 234, the control module 30 determines whether both the signals generated in steps 218 and 232 have been, or are being, received. If both of the signals are not received, then the control module 30 waits in step 236 before returning to step 234 to determine whether both signals are received. If both signals are received in step 234, the control module 30 enables the operation of the pill-crushing mechanism in step 238. The mechanism can then be started under the command of an operator to crush the pills 16

Figure 8:
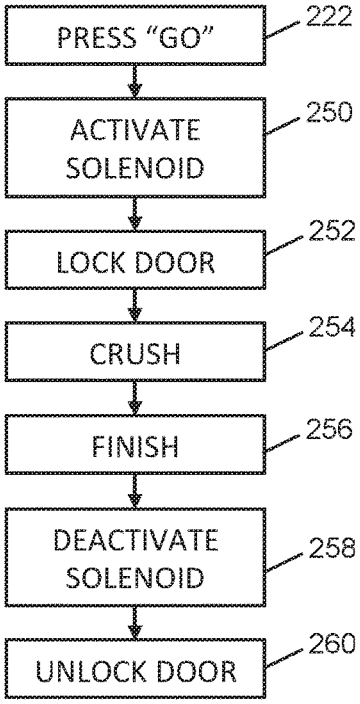
FIG. 8 is a flowchart of additional method steps for preventing opening of a cup-holding drawer until a pill-crushing mechanism has stopped operating, according to an embodiment of the present invention.

FIG. 8 shows further optional steps for locking the drawer 40 while the pill-crushing mechanism is operating. In step 222, the start button 86 is pressed by the operator of the pill-crushing machine. In step 250, the solenoid 80 is activated, which results in the bolt 82 locking the drawer 40 in step 252. In step 254, the pill-crushing mechanism operates to crush the pills 16 while the drawer 40 is locked. In step 256, the mechanism stops as the pill crushing has finished. After the mechanism has stopped, the solenoid 80 is deactivated in step 258. This causes the bolt 82 to be retracted from the bolt hole 84 in the drawer 40 in order to unlock it in step 260. The drawer 40 can then be opened to access the powdered medication.

G. Further Variations

While a straight light path has been shown between the laser 20 and sensor 22, other, complex paths may be employed, such as paths using mirrors to create folded light paths. Multiple light paths may also be employed.

The laser 20 and sensor 22 may be arranged that the laser light intensity that is detected is low when there is no upper cup 18 present and high when the upper cup is present. This may be achieved, for example, by positioning the laser 20 so that its beam reflects off the wall of the upper cup 18 onto the sensor, or off the top surface of the lip 28 of the upper cup and onto the sensor.

The sensor 22 may be located at a level below the lip 24 of the lower cup 14 and directed so that it detects light coming down diagonally from a laser that is positioned accordingly. In this configuration, the beam 21 would be blocked by the lip 28 of the upper cup 18 when present, but not when it is absent.

The signal from the sensor that indicates the presence of the upper cup may not be present during the whole of the crushing process, because, as the process progresses, the upper cup gradually settles lower down into the lower cup, which may unblock the laser beam. The controller is therefore configured to continue crushing the pills even if the sensor would indicate an absence of the upper cup, provided that the upper cup's presence was detected immediately prior to the initiation of the crushing operation.

The laser may be replaced with another light source, such as a non-laser light emitting diode (LED). The light source may optionally be focused.

The pressure plate 56 may have a different form to that shown, and may mechanically engage with the upper cup 18, for example around a polygonal rim. In other pill-crushing machines, the lower cup 14 may be rotated while the upper cup 18 is held stationary.

Mechanical features of the drawer, cup holder and cups may be varied from those shown without departing from the scope of the invention. Mechanical features, shapes and positions are understood to be defined to be within allowable engineering and operating tolerances. For example, where the drawer 40 is described to be fully closed, it is to be understood that it is sufficiently closed for it's purpose, i.e. to allow the safe operation of the pill-crushing machine, even though there may possibly still be travel available to push the door in further.

Sending a signal can be interpreted to be either the actual creation of a signal that is transmitted from a sensor or the ceasing of a signal that is being created by and transmitted from the sensor. Either way, any change in output of the sensor can be interpreted as a signal. A null signal may also be considered to be a signal. The signal may, for example, be a change in voltage, resistance or current.

The invention may be implemented using discrete electronic components and/or one or more processors.

Any type of sensor may be used in embodiments of the invention, so long as the sensor can detect or distinguish between the presence and absence of the upper cup. For example, sensors operating in a different wavelength range may be used. Sensors working on different principles may be used. Other types of sensor systems may also be used which employ different kinds of sources, provided that these systems can detect the presence and absence of the upper cup.

It is conceivable that a mechanical device may be used to detect the presence of the upper cup 18 instead of a source of electromagnetic radiation and corresponding sensor. A mechanical sensor may move from a first position or state when the upper cup 18 is absent to a second position or state when the upper cup is present. The mechanical sensor may operate a microswitch, for example, which signals the presence and absence of the upper cup 18 to the control module 30.

In general, unless otherwise indicated, singular elements may be in the plural and vice versa with no loss of generality.

Throughout the description, specific details have been set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The detailed description has been presented partly in terms of methods or processes, symbolic representations of operations, functionalities and features of the invention. These method descriptions and representations are the means used by those skilled in the art to most effectively convey the substance of their work to others skilled in the art.

It will be clear to one having skill in the art that further variations to the specific details disclosed herein can be made, resulting in other embodiments that are within the scope of the invention disclosed. Steps in the flowcharts may be performed in a different order, other steps may be added, or one or more may be removed without altering the main functions of the system. Steps shown to occur in parallel may be changed to occur sequentially and vice versa. Flowcharts from different figures may be combined in different ways. All parameters, dimensions, materials, and configurations described herein are examples only and actual values of such depend on the specific embodiment. Accordingly, the scope of the invention is to be construed in accordance with the substance defined by the following claims.

The invention claimed is:

1. A system for controlling operation of a pill-crushing mechanism, the system comprising:
- a cup holder configured to hold:
  - a lower cup with one or more pills therein; and
  - an upper cup nestled in the lower cup over said pills;
- a sensor located in relation to the cup holder so that the sensor has:
  - a first state that corresponds to an absence of the upper cup from the cup holder; and
  - a second state that corresponds to a presence of the upper cup in the cup holder, nestled in the lower cup over said pills; and
- a controller that receives signals from the sensor corresponding to said states, wherein the controller:
  - prevents operation of a mechanism for crushing said pills when the sensor is in the first state; and
  - enables operation of the mechanism when the sensor is in the second state.

2. The system of claim 1, further comprising a source of electromagnetic radiation positioned so that:
- the source directs said radiation onto the sensor when the upper cup is absent from the cup holder; and
- the radiation is blocked from being incident upon the sensor when the upper cup is present over the pills in the lower cup in the cup holder;
- wherein the sensor is sensitive to said radiation.

3. The system of claim 2, wherein the source is a laser diode and the sensor is a photodiode.

4. The system of claim 3, wherein the first state is a detection of more laser light than the second state.

5. The system of claim 2, wherein the source and sensor are positioned so that:
- the radiation passes above the lower cup when the lower cup is present in the cup holder and the upper cup is absent from the cup holder; and
- the radiation is blocked from being incident upon the sensor by a wall of the upper cup when the upper cup is present over the pills in the lower cup in the cup holder.

6. The system of claim 1, further comprising a switch connected to the controller wherein:
- when the controller prevents operation of the mechanism, activation of the switch does not start the mechanism; and
- when the controller enables operation of the mechanism, activation of the switch starts the mechanism.

7. The system of claim 1, further comprising a drawer in which is mounted the cup holder, wherein the drawer slides into and out of a pill-crushing machine that comprises the mechanism.

8. The system of claim 7, further comprising a laser diode positioned so that:
- the laser diode directs radiation onto the sensor along a path that is above the lower cup when the lower cup is present in the cup holder and the upper cup is absent from the cup holder; and
- the radiation is blocked from being incident upon the sensor by a wall of the upper cup when the upper cup is present over the pills in the lower cup in the cup holder;

wherein the sensor is sensitive to the radiation; and wherein the path is nearer to an inner edge of the cup holder than an outer edge of the cup holder such that the drawer must be substantially closed for the wall of the upper cup to block the path.

9. A system for controlling operation of a pill-crushing mechanism, the system comprising:

a drawer that slides into and out of a pill-crushing machine that comprises the pill-crushing mechanism;

a cup holder mounted in the drawer and configured to hold:

a lower cup with one or more pills therein; and an upper cup nestled in the lower cup over said pills;

a sensor located in relation to the cup holder so that the sensor has:

a first state that corresponds to an absence of the upper cup from the cup holder; and a second state that corresponds to a presence of the upper cup nestled in the lower cup over said pills;

a magnet mounted in the drawer; and a magnetic sensor mounted in the machine so that it:

detects the magnet when the drawer is closed; and does not detect the magnet when the drawer is not closed; and a controller that receives signals from the sensor that are representative of the sensor's state, and further signals from the magnetic sensor that are representative of whether the drawer is closed, wherein the controller:

prevents operation of the mechanism when the sensor is in the first state or when the drawer is not closed; and enables operation of the mechanism when both the sensor is in the second state and the drawer is closed.

10. The system of claim 9, further comprising a source of electromagnetic radiation positioned so that:

the source directs said radiation onto the sensor when the upper cup is absent from the cup holder; and the radiation is blocked from being incident upon the sensor when the upper cup is present over the pills in the lower cup in the cup holder;

wherein the sensor is sensitive to said radiation.

11. The system of claim 10, wherein the source is a laser diode and the sensor is a photodiode and the source and laser diode are positioned so that:

the radiation passes above the lower cup when the lower cup is present in the cup holder and the upper cup is absent from the cup holder; and the radiation is blocked from being incident upon the photodiode by a wall of the upper cup when the upper cup is present over the pills in the lower cup.

12. The system of claim 9, further comprising a switch connected to the controller wherein:

when the controller prevents operation of the mechanism, activation of the switch does not start the mechanism; and when the controller enables operation of the mechanism, activation of the switch starts the mechanism.

13. The system of claim 9, wherein the magnetic sensor is a reed switch.

14. The system of claim 9, further comprising an interlock that locks the drawer closed while the mechanism operates.

15. The system of claim 14, wherein the interlock comprises:

a bolt hole in a side of the drawer;

a solenoid; and a core in the solenoid that moves, from a first position that is outside of the bolt hole when the solenoid is not activated, to a second position that is in the bolt hole when the solenoid is activated.

16. A method for controlling operation of a pill-crushing mechanism, comprising the steps of:

locating a sensor in relation to a cup holder so that the sensor has:

a first state that corresponds to an absence of an upper cup from a lower cup being held by the cup holder; and a second state that corresponds to a presence of the upper cup nestled in the lower cup over one or more pills in the lower cup;

detecting, by the sensor, whether the upper cup is nestled in the lower cup over the one or more pills therein;

receiving, by a controller, a first signal from the sensor when the sensor is in the first state;

preventing, by the controller, operation of a mechanism for crushing said pills in response to the first signal;

receiving, by the controller, a second signal from the sensor when the sensor is in the second state; and enabling, by the controller, operation of the mechanism when the sensor in response to the second signal.

17. The method of claim 16, further comprising:

emitting electromagnetic radiation from a source;

directing said radiation onto the sensor when the upper cup is absent from the lower cup being held by the cup holder; and blocking said radiation from being incident upon the sensor by the upper cup when the upper cup is present over the pills in the lower cup;

wherein the sensor is sensitive to said radiation.

18. The method of claim 17, further comprising passing the radiation above the lower cup when the lower cup is present in the cup holder and the upper cup is absent from the cup holder, wherein the radiation is blocked from being incident upon the sensor by a wall of the upper cup when the upper cup is present.

19. The method of claim 16, further comprising:

detecting whether a drawer holding the lower cup, the pills and the upper cup is closed in a machine comprising the pill-crushing mechanism;

preventing operation of the mechanism when the drawer is not closed; and detecting, before the enabling step is undertaken, that the drawer is closed.

20. The method of claim 19, further comprising:

detecting activation of a switch to start the mechanism; and activating, by the controller, a solenoid to lock the drawer while the mechanism operates.

* * * * *